US008979559B2

(12) United States Patent
Aldrich et al.

(10) Patent No.: US 8,979,559 B2
(45) Date of Patent: Mar. 17, 2015

(54) LOCKOUT TAGOUT PLUG SLEEVE

(71) Applicants: Alvah Benjamin Aldrich, Geneva, NY (US); Daniel Treible, Clay, NY (US); Joseph Allen Menzel, Camillus, NY (US)

(72) Inventors: Alvah Benjamin Aldrich, Geneva, NY (US); Daniel Treible, Clay, NY (US); Joseph Allen Menzel, Camillus, NY (US)

(73) Assignee: Cooper Technologies Company, Houston, TX (US)

( * ) Notice: Subject to any disclaimer, the term of this patent is extended or adjusted under 35 U.S.C. 154(b) by 154 days.

(21) Appl. No.: 13/715,549

(22) Filed: Dec. 14, 2012

(65) Prior Publication Data

US 2013/0157521 A1 Jun. 20, 2013

Related U.S. Application Data

(60) Provisional application No. 61/570,537, filed on Dec. 14, 2011.

(51) Int. Cl.

| | |
|---|---|
| ***H01R 13/44*** | (2006.01) |
| ***H01R 13/516*** | (2006.01) |
| ***H01R 13/627*** | (2006.01) |
| *H01R 13/64* | (2006.01) |

(52) U.S. Cl.

CPC ..... *H01R 13/516* (2013.01); *H01R 13/6276* (2013.01); *H01R 13/64* (2013.01)

USPC ..... 439/133; 439/680

(58) Field of Classification Search

USPC ..... 439/133, 134, 680

See application file for complete search history.

(56) References Cited

U.S. PATENT DOCUMENTS

| | | | | |
|---|---|---|---|---|
| 4,008,588 | A | 2/1977 | Miller et al. | |
| 4,721,475 | A * | 1/1988 | Burke, Jr. | 439/133 |
| 5,092,359 | A | 3/1992 | Wirth et al. | |
| 5,178,551 | A | 1/1993 | Bach | |
| 5,186,636 | A | 2/1993 | Boyer et al. | |
| 5,273,445 | A * | 12/1993 | Ehrenfels et al. | 439/134 |
| D349,034 | S | 7/1994 | Webster | |
| 5,449,302 | A * | 9/1995 | Yarbrough et al. | 439/680 |
| 5,601,440 | A | 2/1997 | Richter | |
| D384,267 | S | 9/1997 | Giles | |
| D391,469 | S | 3/1998 | Foushee | |
| 6,186,180 | B1 | 2/2001 | Moller et al. | |
| 6,209,365 | B1 | 4/2001 | Neeley | |
| 6,382,001 | B1 | 5/2002 | Neeley et al. | |
| 7,384,282 | B2 | 6/2008 | Tomita et al. | |
| 7,497,705 | B2 | 3/2009 | Larson et al. | |
| D637,471 | S | 5/2011 | Roy | |
| 7,976,072 | B2 | 7/2011 | Parrish | |
| D652,748 | S | 1/2012 | Jilderos et al. | |
| 8,435,061 | B2 * | 5/2013 | Ijima | 439/348 |
| 2011/0294331 | A1 | 12/2011 | Ijima | |

FOREIGN PATENT DOCUMENTS

| | | |
|---|---|---|
| JP | 2000252024 | 9/2000 |

* cited by examiner

*Primary Examiner* — Xuong Chung Trans
(74) *Attorney, Agent, or Firm* — King & Spalding LLP

(57) ABSTRACT

A lockout tagout hole that traverses at least one wall of a cylindrical body of a lockout tagout plug sleeve, where the lockout tagout hole securely receives a lockout tagout tag. Also disposed on the outer surface of the cylindrical body can be a polarizing slot, where the polarizing slot and an end of the wall of the sleeve are used to orient the position of the lockout tagout hole.

18 Claims, 5 Drawing Sheets

LOCKOUT TAGOUT PLUG SLEEVE

CROSS-REFERENCE TO RELATED APPLICATIONS

This application claims priority under 35 U.S.C. §119 to U.S. Provisional Patent Application Ser. No. 61/570,537, titled "Lockout Tagout Plug Sleeve" and filed on Dec. 14, 2011, the entire contents of which are hereby incorporated herein by reference.

TECHNICAL FIELD

Embodiments of lockout tagout plug sleeves relate generally to isolating a power source, and more particularly to systems, methods, and devices for facilitating a lockout tagout tag on a high amperage electrical connector.

BACKGROUND

A plug sleeve can be used to protect one or more pins of an electrical plug connector. The plug sleeve can be mechanically coupled to the electrical plug connector and have one or more of a number of features. For example, a plug sleeve can have a slot to help align the plug connector with a corresponding receptacle that receives the plug connector.

The use of lockout tagout procedures helps ensure safe operations and maintenance of power equipment. A lockout tagout on a sleeve for a high amperage electrical plug helps ensure that the plug cannot be engaged in its corresponding receptacle during maintenance and repair of associated equipment. The location of a lockout tagout should be visible and convenient to access.

SUMMARY

In general, in one aspect, the disclosure relates to a lockout tagout plug sleeve for an electrical connector. The lockout tagout plug sleeve can include a cylindrical body having at least one wall having a length between a first end and a second end, where the at least one wall forms a cavity, and where the cavity receives, toward the second end, an electrical plug assembly. The lockout tagout plug sleeve can also include a polarizing slot disposed on an outer surface of the at least one wall along the length of the at least one wall. The lockout tagout plug sleeve can further include a lockout tagout hole configured to receive a lockout tagout tag, where the lockout tagout hole traverses the at least one wall at a first distance from the first end and is oriented relative to the polarizing slot and the first end.

In another aspect, the disclosure can generally relate to an electrical connector. The electrical connector can include a plug assembly having a plurality of pins. The electrical connector can also include a lockout tagout plug sleeve mechanically coupled to the plug assembly. The lockout tagout plug sleeve can include a cylindrical body having at least one wall having a length between a first end and a second end, where the at least one wall forms a cavity, and where the cavity receives, toward the second end, the plurality of pins. The lockout tagout plug sleeve can also include a polarizing slot disposed on the outer surface of the at least one wall. The lockout tagout plug sleeve can further include a lockout tagout hole configured to receive a lockout tagout tag, where the lockout tagout hole traverses the at least one wall at a distance from the first end and is oriented relative to the polarizing slot and the first end.

These and other aspects, objects, features, and embodiments will be apparent from the following description and the appended claims.

BRIEF DESCRIPTION OF THE DRAWINGS

The drawings illustrate only example embodiments of lockout tagout plug sleeves and are therefore not to be considered limiting of its scope, as the lockout tagout plug sleeves may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
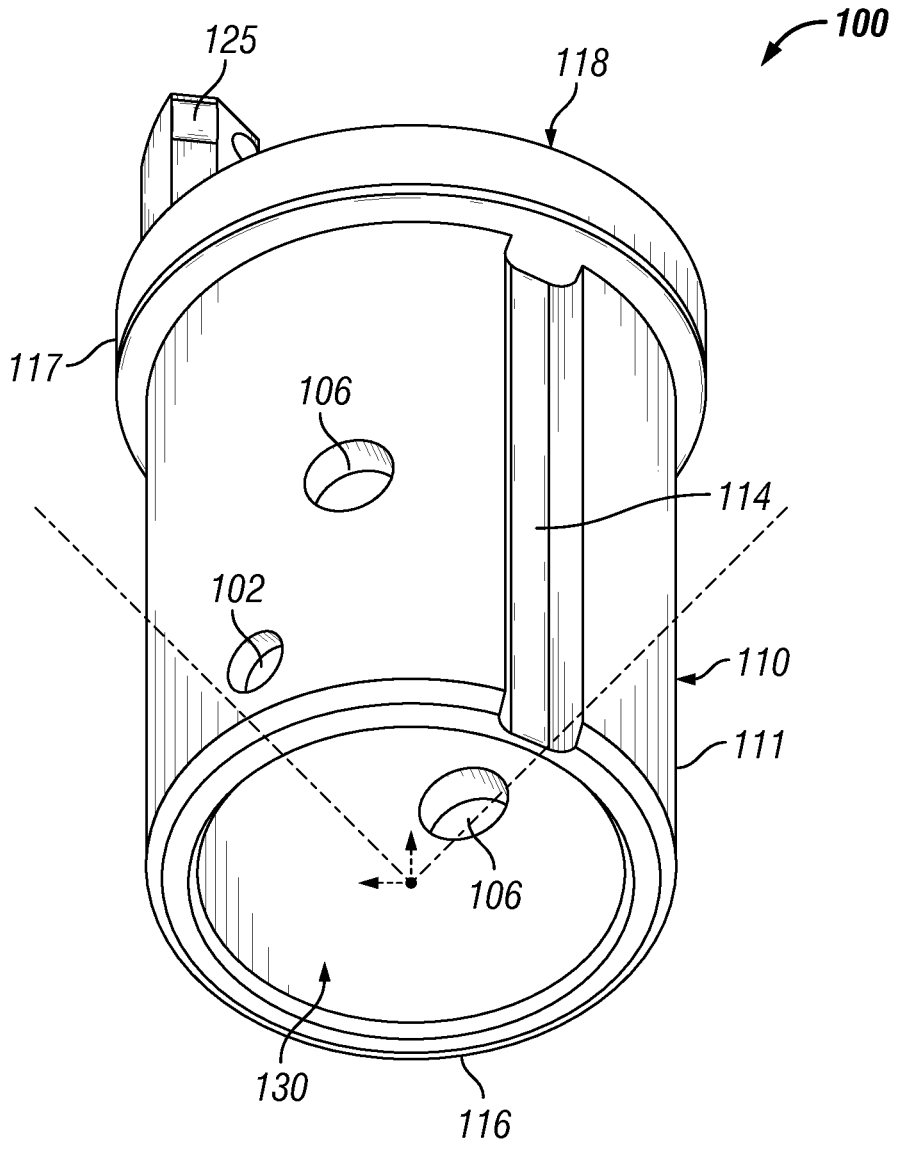
FIG. 1 shows a lockout tagout plug sleeve in accordance with one or more example embodiments.

Example embodiments of lockout tagout plug sleeves will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and height can each generally be described as lateral directions.

Embodiments of lockout tagout plug sleeves are directed to high-amperage electrical connectors that are unplugged from its corresponding receptacle in order to perform maintenance and/or repair on associated equipment. In one or more example embodiments, a lockout tagout plug sleeve includes a lockout tagout hole that traverses at least one side of a cylindrical body of the sleeve. The embodiments described herein may provide several advantages, including but not limited to easier access to secure and unsecure a lockout tagout tag, less likelihood of causing damage to portions of the electrical plug when securing and unsecuring a lockout tagout tag, and easy visibility of a lockout tagout tag that is affixed to a plug through the lockout tagout hole.

In addition, example embodiments of lockout tagout plug sleeve configurations may be based on one or more of a number of variables, including but not limited to connector pin configuration, plug size, amperage rating, and conductor size. Further, example embodiments of lockout tagout plug sleeves may be compliant with one or more of a number of standards. One such standard is UL 1686 set by Underwriters Laboratories. Another such standard is CSA C22.2 No. 182.1 set by the Canadian Standards Association. In addition, the lockout tagout plug sleeves described herein may be made of one or more of a number of suitable materials, including but not limited to metal. Example embodiments may be directed to metal (not plastic) lockout tagout plug sleeves that meet the standards set forth in UL 1686, CSA C22.2 No. 182.1, and/or any other suitable standard.

Example embodiments of lockout tagout plug sleeves now will be described more fully hereinafter with reference to the accompanying drawings, in which example embodiments of lockout tagout plug sleeves are shown. Lockout tagout plug sleeves may, however, be embodied in many different forms and should not be construed as limited to the example embodiments set forth herein; rather, these example embodiments are provided so that this disclosure will be thorough and complete, and will fully convey the scope of lockout tagout plug sleeves to those skilled in the art. Like elements in the various figures are denoted by like reference numerals for consistency.

FIG. 1 shows a lockout tagout plug sleeve 100 in accordance with one or more example embodiments. The cylindrical body 110 of the lockout tagout plug sleeve 100 includes at least one wall 111. The at least one wall 111 can have a first end 116 (also called a sleeve face) that couples to a receptacle (not shown) and a second end 118 that couples to a plug assembly (not shown). The at least one wall 111 of the lockout tagout plug sleeve 100 can be made of an electrically conductive and/or an electrically non-conductive material.

In one or more example embodiments, the at least one wall 111 of the cylindrical body 110 is of a finite thickness, and so forms a cavity 130. The cavity 130 may have a height that is substantially similar to the length of the at least one wall 111. In addition, or in the alternative, the cavity 130 can have a width that is wide enough to receive one or more connector pins (shown in FIG. 3 below), which in turn are configured to mate with receiving pin holes of the corresponding receptacle. When multiple connector pins are positioned in the cavity 130 of the cylindrical body 110, one of the pins may be shorter than the other pins. In such a case, the shorter pin may be a grounding conductor or a grounding pin.

The thickness, length, and/or the shape (in this example, circular) of the at least one wall 111 of the cylindrical body 110 (and, thus, the size and shape of the cavity 130) may be any suitable thickness, length, and/or shape to allow coupling of the lockout tagout plug sleeve 100 to a corresponding receptacle. Likewise, the size and shape of the first end 116 (here, shown with a beveled edge) and the second end 118 (here, shown with a protruding collar 117 and a ground strap receiver 125) may be any suitable size and shape to allow coupling of the lockout tagout plug sleeve 100 to the corresponding receptacle and/or a corresponding plug assembly, respectively.

Figure 4:
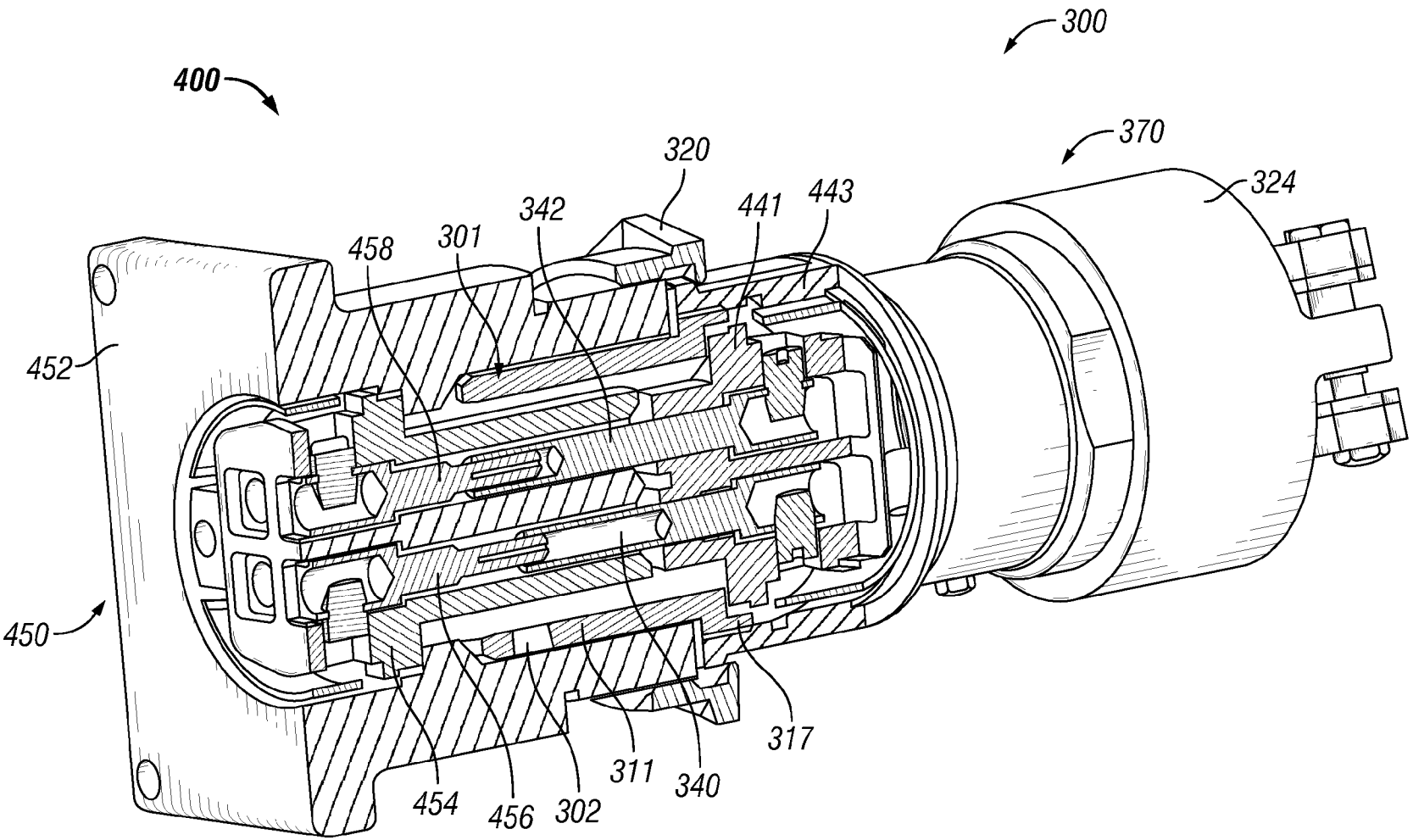
FIG. 4 shows a cross-sectional perspective side view of an example electrical connector system that includes a lockout tagout plug sleeve in accordance with one or more example embodiments.

The protruding collar 117 can be an optional feature of the lockout tagout plug sleeve 100. The protruding collar 117 of the second end 118 can have a larger outer diameter than the outer diameter of the wall 111. Alternatively, or in addition, the protruding collar 117 of the second end 118 can have a smaller outer diameter than the outer diameter of the wall 111. The protruding collar 117 can help secure the lockout tagout plug sleeve 100 within the plug assembly by having features (e.g., a larger outer diameter compared to the outer diameter of the wall 111) that fit within complementary features of the plug assembly. An example of how the protruding collar 117 secures the lockout tagout plug sleeve 100 to the plug assembly are shown in FIG. 4 below.

In certain example embodiments, the optional ground strap receiver 125 protrudes away from a top side of the second end 118. The ground strap receiver 125 can have one or more of a number of features that secure a ground strap within the plug assembly. Such features can include, but are not limited to, an aperture, a clip, a clamp, and a slot. When a ground strap of the plug assembly is mechanically coupled to the ground strap receiver 125, a uniform ground is applied to the lockout tagout plug sleeve 100 and the plug assembly. The ground strap receiver 125 can be made of one or more of a number of electrically conductive materials, which may be the same or different than the material of the at least one wall 111.

Such dimensions of the at least one wall 111, as well as other features of the lockout tagout sleeve 100, can be sized to correspond with an appropriate current rating, voltage rating, and/or any other type of rating of the electrical connector. For example, if an electrical connector is rated for 400 Amperes (A), then the dimensions of the lockout tagout sleeve 100 must be suitable to maintain the 400A rating of the electrical connector when the lockout tagout sleeve 100 is mechanically coupled to the electrical plug assembly.

In one or more example embodiments, the lockout tagout plug sleeve 100 also includes at least one pair of locking receivers 106 disposed at least on the outer surface of the at least one wall 111 of the cylindrical body 110. The pair of locking receivers 106 can be disposed along the length of the at least one wall 111 of the cylindrical body 110. The locking receivers 106 are a type of safety feature. Each of the locking receivers 106 may receive a mating device from the corresponding receptacle and/or plug assembly. The mating device may engage one or both of the pair of locking receivers 106 when the plug assembly and corresponding receptacle are engaged and when current is flowing through the plug assembly and corresponding receptacle. Each locking receiver 106 of the pair of locking receivers may be positioned at some distance from the first end 116 and on opposite sides of the cylindrical body 110, as shown in FIG. 1. The locking receivers 106 may be of any shape, size, and configuration suitable to securely receive the mating devices of the corresponding receptacle and/or plug assembly. In the example embodiment shown in FIG. 1, the locking receivers 106 are holes that traverse the wall 111 of the cylindrical body 110.

In one or more example embodiments, the lockout tagout plug sleeve 100 also includes a polarizing slot 114. The polarizing slot 114 is disposed on the cylindrical body 110 and helps ensure that the plug assembly is properly oriented in order to mate with the corresponding receptacle. The polarizing slot 114 may be any feature on the lockout tagout plug sleeve 100 that allows for a discrete number of orientations of the plug assembly relative to mating with the corresponding receptacle. The polarizing slot 114 of FIG. 1 is a linear groove disposed along the length (carved into the outer surface, in this example) of the wall 111.

In one or more example embodiments, the lockout tagout plug sleeve 100 also includes a lockout tagout hole 102. The lockout tagout hole 102 is an aperture that traverses the wall 111 and has dimensions (e.g., shape, width) to receive a lockout tagout tag. A lockout tagout tag can be a physical tag with wording to warn that the device to which the lockout tagout tag is attached is not to be started, used, or otherwise operated. A lockout tagout tag may also be known by other names, including but not limited to a hold tag. The lockout tagout tag includes a feature (e.g., a cable tie, a metal wire, a clamp) that traverses the lockout tagout hole 102, and that physically attaches to the lockout tagout tag and to itself.

In FIG. 1, the lockout tagout hole 102 traverses a wall 111 of the cylindrical body 110 at some distance from the first end 116 of the cylindrical body 110. For example, the lockout tagout hole 102 can be located approximately 0.41 inches from the first end 116. Such a distance can be measured from an approximate center of the lockout tagout hole 102, the top of the lockout tagout hole 102, the bottom of the lockout tagout hole 102, or any other location on or proximate to the lockout tagout hole 102. Thus, the lockout tagout hole 102 is configured to receive one or more lockout tagout tags. In this example, the lockout tagout hole 102 is positioned closer to the first end 116 of the cylindrical body 110 when compared to the position of the locking receivers 106 from the first end 116 of the cylindrical body 110.

The lockout tagout hole 102 may traverse the wall 111 of the cylindrical body 110 at one of a number of locations. Specifically, the location of the lockout tagout hole 102 on the lockout tagout plug sleeve 100 can be described with respect to a distance (in a horizontal direction) from the first end 116 and/or with respect to an angle (in a vertical direction) from the polarizing slot 114. For example, the lockout tagout hole 102 can be positioned approximately 0.5 inches from the first end 116 and approximately 15° to the left of (counterclockwise from) the polarizing slot 114. In addition, or in the alternative, the position of the lockout tagout hole 102 can be described with respect to one or more other features of the lockout tagout plug sleeve 100, including but not limited to the second end 118 and the pair of locking receivers 106.

In addition, or in the alternative, the position of the lockout tagout hole 102 on the lockout tagout plug sleeve 100 can be described in one or more other ways. For example, the position of the lockout tagout hole 102 on the lockout tagout plug sleeve 100 can be described in terms of clock position, where in the example embodiment shown in FIG. 1, the lockout tagout hole 102 is located (looking from the first end 116) at about 11:15, where 12:00 is represented by the polarizing slot 114. Further, the lockout tagout hole 102 of example FIG. 1 is located closer to the first end 116 of the cylindrical body 110 than is the pair of locking receivers 106. In addition, along the length of the wall 111 of the lockout tagout plug sleeve 100, the lockout tagout hole 102 is not aligned with either of the pair of locking receivers 106.

Any measure of the lockout tagout hole 102 relative to the polarizing slot 114 can be made from the center of the lockout tagout hole 102 and/or the polarizing slot 114, from the left side of the lockout tagout hole 102 and/or the polarizing slot 114, the right side of the lockout tagout hole 102 and/or the polarizing slot 114, and/or any other location on or proximate to the lockout tagout hole 102 and/or the polarizing slot 114.

One or more of a number of features (e.g., dimensions of the at least one wall 111, orientation of the pair of locking receivers 106) of the lockout tagout plug sleeve 100 can be used to categorize a style of the lockout tagout plug sleeve 100. A number of styles for the lockout tagout plug sleeve 100 can exist and can follow protocols set by industry standards, manufacturer's specifications, and/or some other entity or protocol. For example, a lockout tagout plug sleeve 100 can have a style 1, a style 2, or a style 1 and 2.

The following table provides example dimensions and/or categorizations for various example lockout tagout plug sleeves. The positions listed are the position of the lockout tagout hole 102 relative to the polarizing slot 114, in degrees, traveling in a clockwise direction from the polarizing slot 114.

TABLE 1

Example characteristics of a lockout tagout plug sleeve.

| Sleeve Outer Diameter (inches) | Position (°) | Current Rating (A) | Style | Location from first end (inches) |
|---|---|---|---|---|
| 2.28 | 315 | 30 | 1 | 0.41 |
| 1.865 | 112.5 | 30 | 1 | 0.41 |
| 1.865 | | | | |
| 1.853 | 135 | 30 | 1 | 0.41 |
| 2.28 | 45 | 30 | 2 | 0.41 |
| 1.865 | 67.5 | 30 | 2 | 0.41 |
| 1.865 | | | | |
| 1.854 | 90 | 30 | 2 | 0.41 |
| 2.546 | 134.5 | 60 | 1 | 0.41 |
| 2.736 | | | | |
| 2.724 | 180 | 60 | 1 | 0.41 |
| 2.234 | 135 | 60 | 1 | 0.41 |
| 2.540 + .010 | | | | |
| −.006 | 45 | 60 | 1 | 0.41 |
| 2.24 | 67.5 | 60 | 2 | 0.41 |
| 2.546 | 67.5 | 60 | 2 | 0.41 |
| 2.736 | | | | |
| 2.725 | 135 | 60 | 2 | 0.41 |
| 2.234 | | | | |
| +.005 − .010 | 90 | 60 | 2 | 0.41 |
| 2.540 | 90 | 60 | 2 | 0.41 |
| 2.7295 | 67.5 | 100 | 1 | 0.41 |
| 2.59 | 22.5 | 100 | 1 | 0.41 |
| 2.48 | 45 | 100 | 1 | 0.41 |
| 2.730 | 270 | 100 | 1 | 0.41 |
| 2.59 | 67.5 | 100 | 2 | 0.41 |
| 2.480 | 0 | 100 | 2 | 0.41 |
| 2.730 | 45 | 100 | 2 | 0.41 |
| 3.724 | 45 | 200 | ½ | 0.41 |
| 4.103 4.098 | | 200 | | |
| 4.656 | 45 | 400 | 1/2 | 0.41 |
| 2.73 | | | | 0.41 |

Figure 2A:
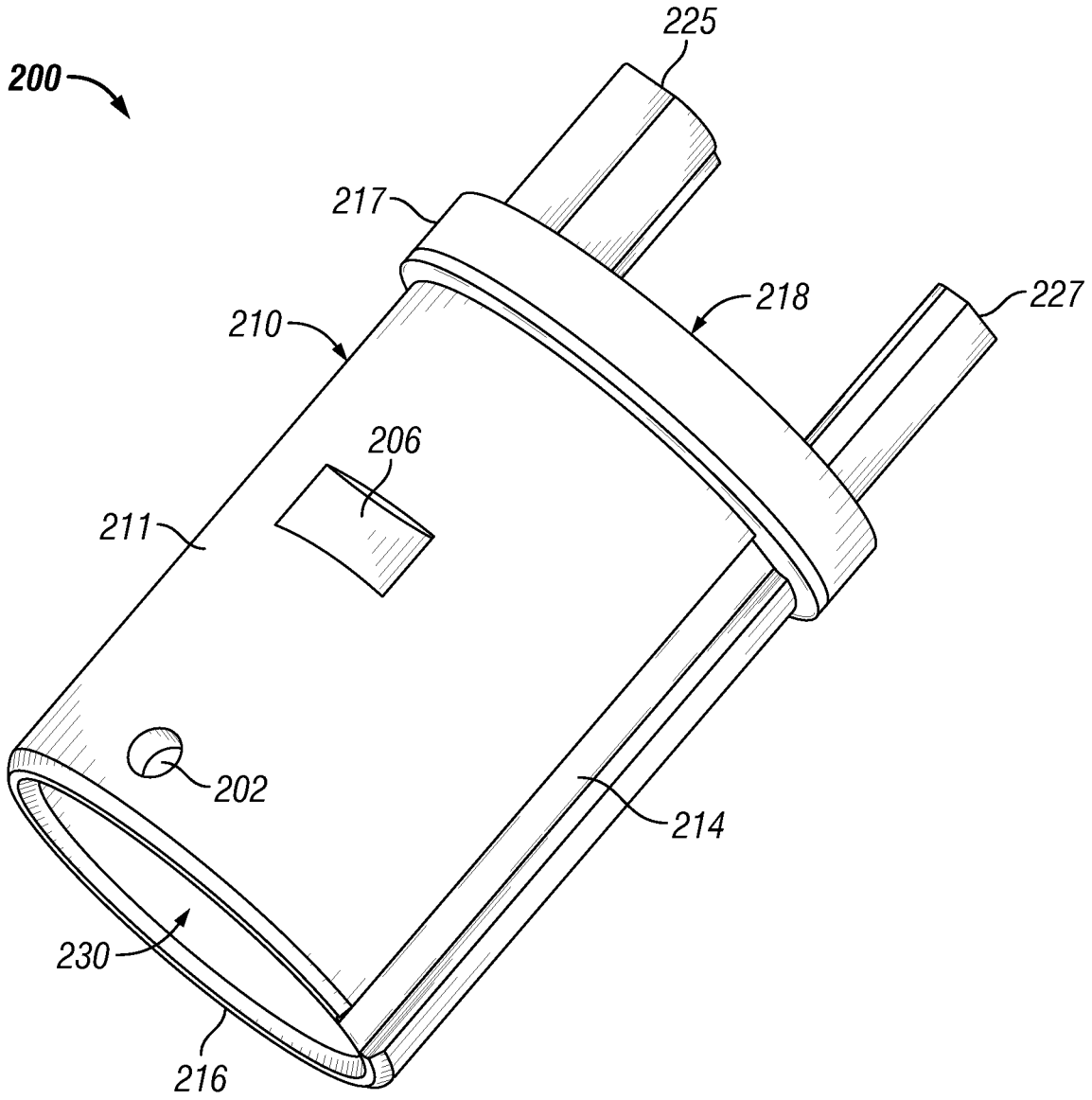
FIGS. 2A and 2B show different views of a lockout tagout plug sleeve in accordance with one or more example embodiments.
Figure 2B:
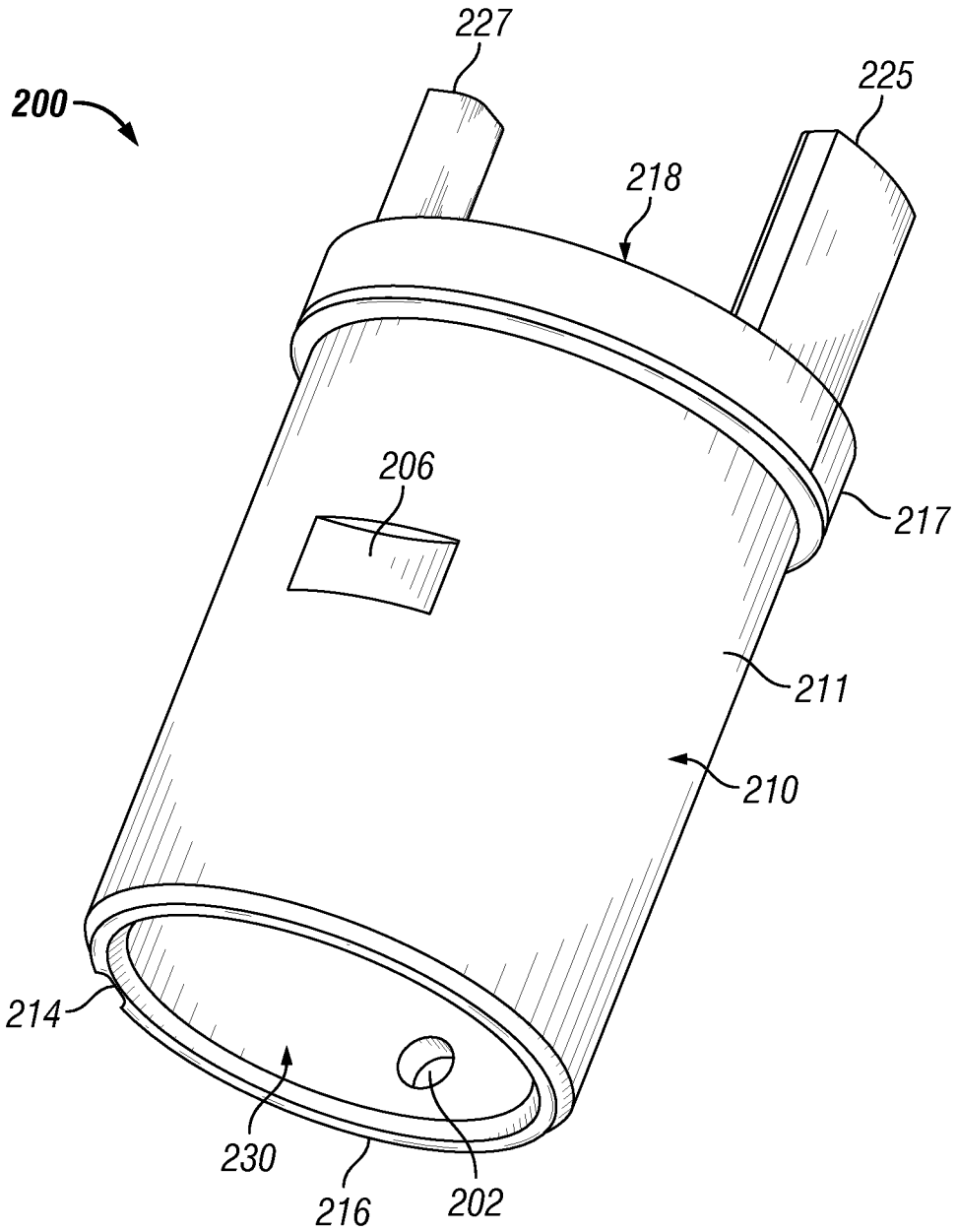

FIGS. 2A and 2B show different views of another example lockout tagout plug sleeve 200 in accordance with one or more example embodiments. As described above with respect to FIG. 1, the lockout tagout plug sleeve 200 shown in FIGS. 2A and 2B includes a cylindrical body 210 that includes at least one wall 211 that forms a cavity 230. The wall 211 includes a first end 216, a second end 218, a polarizing slot 214, a pair of locking receivers 206, and a lockout tagout hole 202.

In this example, the cavity 211, the first end 216, the second end 218, the polarizing slot 214, and the lockout tagout hole 202 are substantially similar to the corresponding elements described above with respect to FIG. 1. In this example, the lockout tagout plug sleeve 200 of FIG. 2, the lockout tagout hole 202 is located at approximately 9:00, where 12:00 is represented by the polarizing slot 214. Further, the pair of locking receivers 206 are substantially similar to those described above with respect to FIG. 1, except that in FIGS. 2A and 2B the pair of locking receivers 206 are parallel slots disposed laterally on the outer surface of the wall 211 of the cylindrical body 210, and the pair of locking receivers 206 do not completely traverse or pierce the wall 211 of cylindrical body 210.

Figure 3:
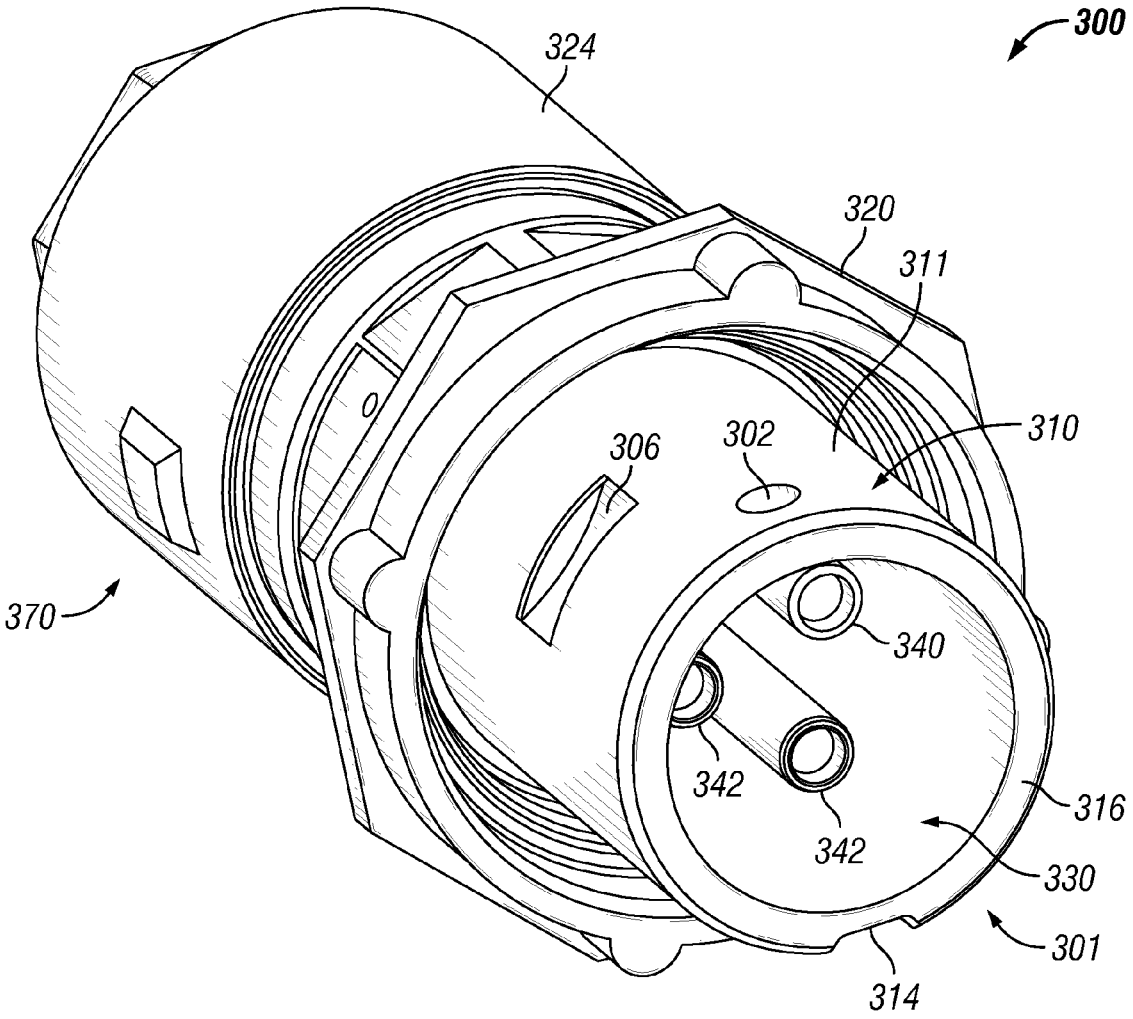
FIG. 3 shows an example connector that includes a lockout tagout plug sleeve in accordance with one or more example embodiments.

FIG. 3 shows an example connector 300 (also called an electrical connector) that includes a lockout tagout plug sleeve 301 in accordance with one or more example embodiments. The lockout tagout plug sleeve 301 of FIG. 3 is substantially similar to the lockout tagout plug sleeve 200 of FIGS. 2A and 2B above. In addition to the lockout tagout plug sleeve 301, the connector 300 includes a plug assembly 370. The plug assembly 370 includes three connector pins (two standard connector pins 342 and a ground pin 340), a connecting collar 320, and a body 324. In the example connector 300 of FIG. 3, the lockout tagout hole 302 of the lockout tagout sleeve 301 is located at approximately 6:00, where 12:00 is represented by the polarizing slot 314. As described above, the lockout tagout hole 302 is positioned closer to the ground pin 340 of the plug assembly 370 than the other standard connector pins 342. Alternatively, the lockout tagout hole 302 may be positioned closer to one of the standard connector pins 342 than the ground pin 340.

In one or more example embodiments, the connecting collar 320 is used to couple the lockout tagout plug sleeve 301 to the body 324 of the plug assembly 370, where the body houses the conductors that connect to the standard connector pins 342 and/or the ground pin 340. The connector 300 may include one or more other elements and/or have one or more other configurations. The lockout tagout plug sleeve 301 may be configured to mechanically couple to the plug assembly 370 and/or to the corresponding receptacle (not shown).

The pins (e.g., the connector pins 342, the ground pin 340) of the plug assembly 370 can be of any number (e.g., 2, 3, 4, 5) and be of the same and/or different lengths and/or widths relative to each other. In certain example embodiments, the pins of the plug assembly do not include a ground pin 340. Alternatively, when the pins of the plug assembly include a ground pin 340, the ground pin 340 can have the same and/or different length and/or a same and/or different width as the remainder of the pins (e.g., the connector pins 342).

FIG. 4 shows a cross-sectional perspective side view of an example electrical connector system 400 that includes a lockout tagout plug sleeve in accordance with one or more example embodiments. Specifically, the system 400 of FIG. 4 includes the connector 300 of FIG. 3 coupled to a corresponding receptacle 450. The various components (e.g., lockout tagout plug sleeve 301, plug assembly 370) of the system 400 are substantially the same as the corresponding components described above. Differences, alternatives, and/or additions to what has previously been described are described below. Example embodiments are not limited to the configuration shown in FIG. 4 and discussed herein.

The receptacle 450 includes a receptacle body 452 that houses a receptacle insulator 454. In certain example embodiments, there is a gap between the receptacle body 452 and the receptacle insulator 454. When the receptacle 450 is mechanically coupled to the connector 300, the lockout tagout plug sleeve 301 slides into the gap between the receptacle body 452 and the receptacle insulator 454. Further, as the receptacle 450 is mechanically coupled to the connector 300, the conductor pins 458 and the ground pin 456 is inserted into the connector pins 342 and the ground pin 340, respectively, of the plug assembly 370. In certain example embodiments, the conductor pins 458 and the ground pin 456 are disposed within the receptacle insulator 454.

In this example, the ground pin 340 and the connector pins 342 of the plug assembly 370 have cavities, into which the ground pin 456 and conductor pins 458 of the receptacle 450 are disposed when the receptacle 450 and the plug assembly 370 are coupled to each other. Alternatively, the ground pin 456 and/or the conductor pins 458 of the receptacle 450 can have cavities, into which the ground pin 340 and/or the connector pins 342 of the plug assembly 370 can be disposed when the receptacle 450 and the plug assembly 370 are coupled to each other.

As can be seen in FIG. 4, the lockout tagout plug sleeve 301 is mechanically coupled to the plug assembly 370. Specifically, the lockout tagout plug sleeve 301 is positioned between the plug body 443 and the plug insulator 441 of the plug assembly 370. The lockout tagout hole 302 can be seen positioned adjacent to the ground pin 340 of the plug assembly 370 and the ground pin 456 of the receptacle 450. Specifically, the ground pin 340 and the ground pin 456 are positioned within the cavity 330 of the lockout tagout plug sleeve 301 closer to the lockout tagout hole 302 than any of the connector pins 342 or the conductor pins 458.

Example embodiments of the lockout tagout plug sleeve allow for easier application of a lockout tagout tag to a plug assembly. Application of the lockout tagout tag to the plug assembly is important to the safety of electricians, mechanics, and other personnel that work with or near electrical components. When the lockout tagout tag is applied to the lockout tagout hole of the example lockout tagout plug sleeve, an electrical connection using the plug assembly cannot be achieved. Thus, the associated system remains de-energized and safe for workers to perform maintenance work on the associated system.

Accordingly, many modifications and other embodiments set forth herein will come to mind to one skilled in the art to which lockout tagout plug sleeves pertain having the benefit of the teachings presented in the foregoing descriptions and the associated drawings. Therefore, it is to be understood that lockout tagout plug sleeves are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lockout tagout plug sleeve for an electrical connector, the lockout tagout plug sleeve comprising:

a cylindrical body comprising at least one wall having a length between a first end and a second end, wherein the at least one wall forms a cavity, wherein the cavity is configured to have disposed therein an electrical plug assembly; and a lockout tagout hole configured to receive a lockout tagout tag, wherein the lockout tagout hole traverses the at least one wall at a first distance from the first end, wherein the electrical plug assembly comprises a plurality of pins that are positioned within the cavity when the electrical plug assembly is coupled to the second end of the cylindrical body, wherein the plurality of pins comprises a ground pin that is shorter than a remainder of the plurality of pins, wherein the ground pin is positioned within the cavity closer to the lockout tagout hole than any of the remainder of the plurality of pins.

2. The lockout tagout plug sleeve of claim 1, further comprising:

a pair of locking receivers disposed on the outer surface of the at least one wall, wherein each locking receiver of the pair of locking receivers is positioned at a second distance from the first end and on opposite sides of the cylindrical body, wherein the first distance is greater than the second distance.

3. The lockout tagout plug sleeve of claim 1, wherein the second end comprises a ground strap receiver that protrudes away from a top side of the second end.

4. The lockout tagout plug sleeve of claim 1, wherein the ground strap receiver is made of an electrically conductive material and comprises at least one feature for securing a ground strap.

5. The lockout tagout plug sleeve of claim 1, wherein the second end comprises a protruding collar extends radially away from the at least one wall, wherein a first outer diameter of the protruding collar is greater than a second outer diameter of the at least one wall.

6. The lockout tagout plug sleeve of claim 1, wherein the electrical plug assembly complies with standard UL 1686 set by Underwriters Laboratories.

7. The lockout tagout plug sleeve of claim 1, further comprising:

a polarizing slot disposed on an outer surface of the at least one wall along the length of the at least one wall.

8. The lockout tagout plug sleeve of claim 7, wherein the lockout tagout hole is located approximately 0.41 inches from the first end and approximately 15° counterclockwise from the polarizing slot.

9. An electrical connector, comprising:

a plug assembly comprising a plurality of pins, wherein the plurality of pins comprises a ground pin that is shorter than a remainder of the plurality of pins; and a lockout tagout plug sleeve mechanically coupled to the plug assembly, wherein the lockout tagout sleeve comprises:

a cylindrical body comprising at least one wall having a length between a first end and a second end, wherein the at least one wall forms a cavity, wherein the cavity receives, toward the second end, the plurality of pins; and a lockout tagout hole configured to receive a lockout tagout tag, wherein the lockout tagout hole traverses the at least one wall at a distance from the first end and is positioned closer to the ground pin relative to any of the remainder of the plurality of pins.

10. The electrical connector of claim 9, wherein the plug assembly is rated for 400 Amperes.

11. The electrical connector of claim 9, further comprising:

a lockout tagout tag that is removably coupled to the lockout tagout plug sleeve by traversing the lockout tagout hole.

12. The electrical connector of claim 11, wherein the lockout tagout tag, when coupled to the lockout tagout plug sleeve by traversing the lockout tagout hole, prevents a receptacle from mechanically coupling to the plug assembly.

13. The electrical connector of claim 9, wherein the lockout tagout further comprises a pair of locking receivers disposed on the outer surface of the at least one wall.

14. The electrical connector of claim 13, wherein each of the pair of locking receivers is an aperture that traverses the at least one wall.

15. The electrical connector of claim 13, wherein the pair of locking receivers are parallel slots disposed laterally on the outer surface of the at least one wall.

16. The electrical connector of claim 9, wherein the lockout tagout plug sleeve further comprises a polarizing slot disposed on the outer surface of the at least one wall.

17. The electrical connector of claim 16, further comprising:

a receptacle removably coupled to the plug assembly and the lockout tagout plug sleeve.

18. The electrical connector of claim 17, wherein the receptacle comprises a feature that corresponds to and mechanically couples to the polarizing slot of the lockout tagout plug sleeve.

* * * * *